US008001693B2

(12) United States Patent
Onion

(10) Patent No.: US 8,001,693 B2
(45) Date of Patent: Aug. 23, 2011

(54) CLOSABLE KNIFE WITH OPENING MECHANISM

(76) Inventor: Kenneth J. Onion, Kaneohe, HI (US)

( * ) Notice: Subject to any disclaimer, the term of this patent is extended or adjusted under 35 U.S.C. 154(b) by 137 days.

(21) Appl. No.: 11/422,309

(22) Filed: Jun. 5, 2006

(65) Prior Publication Data

US 2007/0068000 A1 Mar. 29, 2007

Related U.S. Application Data

(60) Provisional application No. 60/687,503, filed on Jun. 3, 2005.

(51) Int. Cl.
*B26B 1/02* (2006.01)
*B26B 1/04* (2006.01)

(52) U.S. Cl. ..... 30/155; 30/161

(58) Field of Classification Search ..... 30/57, 66–67, 30/153, 155–161, 330–331; D8/99
See application file for complete search history.

(56) References Cited

U.S. PATENT DOCUMENTS

| | | | | |
|---|---|---|---|---|
| 23,975 | A | 5/1859 | Belcher | |
| 57,902 | A | 9/1866 | Hibbard | |
| 199,966 | A * | 2/1878 | Elmer | 30/161 |
| 226,910 | A | 4/1880 | Friebertshauser | |
| 338,251 | A | 3/1886 | Crandall et al. | |
| 382,967 | A | 5/1888 | Fullerton | |
| D137,408 | S | 6/1890 | Herrick | |
| 530,792 | A | 12/1894 | Nordlow | |
| 551,052 | A | 12/1895 | Waldron et al. | |
| 552,928 | A | 1/1896 | Russell | |
| 557,760 | A | 4/1896 | Brauer | |
| 577,593 | A | 2/1897 | Bronson et al. | |
| 600,442 | A | 3/1898 | Nell | |
| 616,689 | A | 12/1898 | Ruettgers | |
| 749,230 | A | 1/1904 | Severance | |
| 777,358 | A | 12/1904 | Weck | |
| 825,976 | A | 7/1906 | Neiglick | |
| 845,792 | A | 3/1907 | Jenkins | |
| 969,909 | A | 9/1910 | Schrade et al. | |
| 1,057,525 | A | 4/1913 | Bruecker | |
| 1,189,005 | A | 6/1916 | Seely | |
| 1,315,503 | A | 9/1919 | Hughes | |
| 1,315,901 | A | 9/1919 | Ballinger | |
| 1,319,532 | A | 10/1919 | Rasmussen | |
| 1,357,398 | A | 11/1920 | Haywood | |

(Continued)

FOREIGN PATENT DOCUMENTS

| | | |
|---|---|---|
| DE | 29 469 | 6/1884 |

(Continued)

*Primary Examiner* — Jason Daniel Prone
(74) *Attorney, Agent, or Firm* — Holland & Hart

(57) ABSTRACT

A knife includes a handle and a blade coupled to the handle so as to be movable between an open position in which the blade extends from the handle, and a closed position, in which the blade is received within the handle. A detent mechanism is configured to resist movement of the blade from the closed position toward the open position while less than a threshold bias is applied to the blade toward the open position, but to release the blade to move toward the open position when at least the threshold bias is applied to the blade toward the open position. The threshold bias is of such a degree that, when the blade is released by the detent mechanism, sufficient energy is imparted by the bias to the blade to carry the blade from the closed position to the open position.

8 Claims, 3 Drawing Sheets

U.S. PATENT DOCUMENTS

Figure 1:
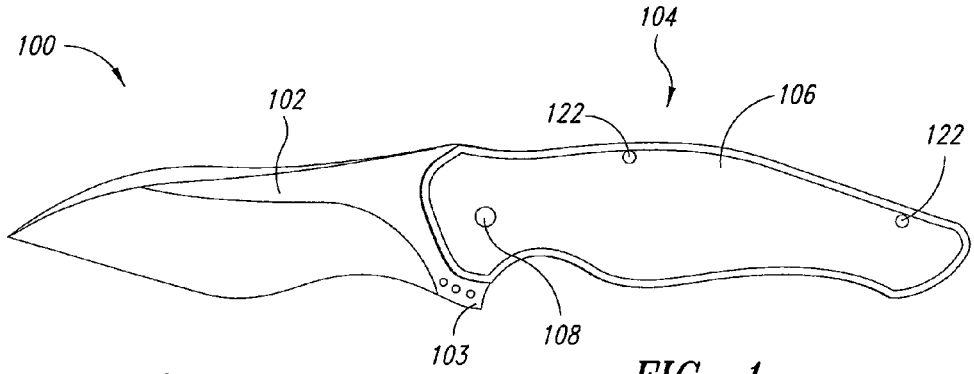

| | | | | | |
|---|---|---|---|---|---|
| 1,412,373 | A | | 4/1922 | Shields | |
| 1,417,872 | A | | 5/1922 | Wall | |
| 1,440,793 | A | | 1/1923 | Rasmussen | |
| 1,454,665 | A | | 5/1923 | Bobek | |
| 1,496,188 | A | | 6/1924 | Wall | |
| 1,515,688 | A | | 11/1924 | Love | |
| 1,584,165 | A | | 5/1926 | Brown | |
| 1,603,914 | A | | 10/1926 | Hermann | |
| 1,614,949 | A | | 1/1927 | Finley | |
| 1,701,027 | A | | 2/1929 | Brown | |
| 1,738,496 | A | | 12/1929 | Laux | |
| 1,743,022 | A | | 1/1930 | Carman | |
| 1,810,031 | A | | 6/1931 | Schrade | |
| 1,864,011 | A | | 6/1932 | Brown | |
| 2,265,775 | A | * | 12/1941 | McNamara | 30/156 |
| 2,284,168 | A | | 5/1942 | Rickenbacher | 30/162 |
| 2,286,524 | A | | 6/1942 | Wilbur | 30/161 |
| 2,407,897 | A | | 9/1946 | Newman | 30/159 |
| 2,455,765 | A | | 12/1948 | Harvey | 248/360 |
| 2,736,959 | A | | 3/1956 | Simon et al. | 30/123 |
| 3,079,784 | A | | 3/1963 | Pavioski | 70/456 |
| 3,404,456 | A | | 10/1968 | Chilko | 30/155 |
| 3,868,774 | A | | 3/1975 | Miori | 30/161 |
| 4,040,181 | A | | 8/1977 | Johnson | 30/161 |
| 4,133,106 | A | | 1/1979 | Addis | 30/160 |
| 4,148,140 | A | | 4/1979 | Lile | 30/161 |
| 4,173,068 | A | | 11/1979 | Cargill | 30/161 |
| 4,211,003 | A | | 7/1980 | Collins | 30/162 |
| 4,218,819 | A | | 8/1980 | Phelps | 30/157 |
| 4,240,201 | A | | 12/1980 | Sawby et al. | 30/161 |
| 4,268,960 | A | | 5/1981 | Reinschreiber | 30/161 |
| 4,274,200 | A | | 6/1981 | Coder | 30/161 |
| 4,322,885 | A | | 4/1982 | Osada | 30/162 |
| 4,347,665 | A | | 9/1982 | Glesser | 30/161 |
| 4,356,631 | A | | 11/1982 | Guth | 30/154 |
| 4,389,775 | A | | 6/1983 | Collins | 30/156 |
| 4,404,748 | A | | 9/1983 | Wiethoff | 30/161 |
| 4,426,779 | A | | 1/1984 | Morgan | 30/138 |
| 4,439,922 | A | | 4/1984 | Sassano | 30/161 |
| 4,442,600 | A | | 4/1984 | Felix-Dalichow | 30/161 |
| 4,451,982 | A | | 6/1984 | Collins | 30/161 |
| 4,466,561 | A | | 8/1984 | Slaughter | 224/163 |
| 4,481,712 | A | | 11/1984 | Phelps | 30/151 |
| 4,494,309 | A | | 1/1985 | Gray | 30/151 |
| 4,494,310 | A | | 1/1985 | Slaughter | 30/155 |
| 4,502,221 | A | | 3/1985 | Pittman | 30/160 |
| 4,525,928 | A | | 7/1985 | Foster | 30/158 |
| 4,529,111 | A | | 7/1985 | Hayakawa | 224/163 |
| 4,541,175 | A | | 9/1985 | Boyd et al. | 30/161 |
| 4,541,556 | A | | 9/1985 | Collins et al. | 224/196 |
| 4,551,917 | A | * | 11/1985 | Walker | 30/161 |
| 4,561,577 | A | | 12/1985 | Moore | 224/232 |
| 4,570,341 | A | | 2/1986 | Konneker | 30/161 |
| 4,600,133 | A | | 7/1986 | Maihos | 224/232 |
| 4,604,803 | A | | 8/1986 | Sawby | 30/161 |
| 4,612,706 | A | | 9/1986 | Yunes | 30/160 |
| 4,670,984 | A | | 6/1987 | Rickard | 30/161 |
| 4,719,700 | A | | 1/1988 | Taylor, Jr. | 30/158 |
| 4,741,106 | A | | 5/1988 | Yamagishi | 30/161 |
| 4,776,094 | A | | 10/1988 | Glesser | 30/160 |
| 4,802,279 | A | | 2/1989 | Rowe | 30/155 |
| 4,805,303 | A | | 2/1989 | Gibbs | 30/161 |
| 4,805,819 | A | | 2/1989 | Collins | 224/232 |
| 4,811,486 | A | | 3/1989 | Cunningham | 30/161 |
| 4,837,932 | A | | 6/1989 | Elsener | 30/161 |
| 4,848,000 | A | | 7/1989 | O'Dell | 30/158 |
| 4,893,409 | A | | 1/1990 | Poehlmann | 30/161 |
| 4,896,424 | A | | 1/1990 | Walker | 30/349 |
| 4,909,424 | A | | 3/1990 | Reynolds | 224/232 |
| 4,947,552 | A | | 8/1990 | Barnes | 30/161 |
| 4,974,323 | A | | 12/1990 | Cassady | 30/155 |
| 4,979,301 | A | | 12/1990 | Walker | 30/161 |
| 5,044,079 | A | | 9/1991 | Gibbs | 30/160 |
| 5,060,379 | A | | 10/1991 | Neely | 30/161 |
| 5,092,045 | A | | 3/1992 | Boyd, Jr. et al. | 30/161 |
| 5,095,624 | A | | 3/1992 | Ennis | 30/161 |
| 5,111,581 | A | | 5/1992 | Collins | 30/161 |
| 5,123,167 | A | | 6/1992 | Kelley | 30/151 |
| 5,131,149 | A | | 7/1992 | Thompson et al. | 30/161 |
| D333,251 | S | | 2/1993 | Glesser | D8/99 |
| D336,602 | S | | 6/1993 | Thompson et al. | D8/99 |
| 5,217,150 | A | | 6/1993 | Chen | 224/163 |
| 5,217,151 | A | | 6/1993 | Parsons | 224/253 |
| D345,289 | S | | 3/1994 | Sakai | D8/99 |
| 5,293,690 | A | | 3/1994 | Cassady | 30/161 |
| D348,599 | S | | 7/1994 | Sakai | D8/99 |
| 5,325,588 | A | | 7/1994 | Rogers | 30/161 |
| 5,331,741 | A | | 7/1994 | Taylor, Jr. | 30/158 |
| 5,349,753 | A | | 9/1994 | Gaffney | 30/155 |
| 5,361,497 | A | | 11/1994 | Crawford | 30/155 |
| 5,400,509 | A | | 3/1995 | Collins | 30/161 |
| 5,425,175 | A | | 6/1995 | Rogers | 30/161 |
| 5,437,101 | A | | 8/1995 | Collins | 30/153 |
| 5,450,670 | A | | 9/1995 | Sakai | 30/298.4 |
| 5,461,786 | A | | 10/1995 | Miller | 30/161 |
| D366,408 | S | | 1/1996 | Sessions et al. | D8/99 |
| 5,493,781 | A | | 2/1996 | Saito | 30/162 |
| 5,502,895 | A | | 4/1996 | Lemaire | 30/158 |
| 5,511,310 | A | | 4/1996 | Sessions et al. | 30/161 |
| 5,511,311 | A | | 4/1996 | Collins | 30/162 |
| 5,515,610 | A | | 5/1996 | Levin et al. | 30/161 |
| 5,537,750 | A | | 7/1996 | Seber et al. | 30/161 |
| 5,546,662 | A | | 8/1996 | Seber et al. | 30/161 |
| D373,716 | S | | 9/1996 | Keys et al. | D8/107 |
| 5,581,895 | A | | 12/1996 | Jeffcoat | 30/294 |
| 5,596,808 | A | | 1/1997 | Lake et al. | 30/161 |
| 5,615,484 | A | | 4/1997 | Pittman | 30/161 |
| 5,647,129 | A | | 7/1997 | Stamper | 30/139 |
| D385,173 | S | | 10/1997 | McWillis | D8/99 |
| 5,685,079 | A | | 11/1997 | Brothers et al. | 30/161 |
| 5,689,885 | A | | 11/1997 | Walston | 30/160 |
| 5,692,304 | A | | 12/1997 | Campbell | 30/161 |
| 5,699,615 | A | | 12/1997 | Chen | 30/160 |
| D392,538 | S | | 3/1998 | Buck et al. | D8/99 |
| D392,539 | S | | 3/1998 | Balolia | D8/99 |
| 5,737,841 | A | | 4/1998 | McHenry et al. | 30/161 |
| 5,755,035 | A | | 5/1998 | Weatherly | 30/161 |
| 5,781,998 | A | | 7/1998 | Stamper | 30/139 |
| 5,802,722 | A | | 9/1998 | Maxey et al. | 30/160 |
| D399,113 | S | | 10/1998 | Balolia | D8/99 |
| 5,815,927 | A | | 10/1998 | Collins | 30/161 |
| 5,819,414 | A | | 10/1998 | Marifone | 30/160 |
| 5,822,866 | A | | 10/1998 | Pardue | 30/161 |
| 5,822,867 | A | | 10/1998 | Sakai | 30/298.4 |
| 5,826,340 | A | | 10/1998 | Hull | 30/161 |
| 5,839,194 | A | | 11/1998 | Bezold | 30/161 |
| 5,845,404 | A | | 12/1998 | Jeffcoat | 30/125 |
| D407,003 | S | | 3/1999 | Macowski et al. | D8/99 |
| 5,875,552 | A | | 3/1999 | Chen | 30/161 |
| 5,878,500 | A | | 3/1999 | Emerson | 30/158 |
| 5,887,347 | A | | 3/1999 | Gibbs | 30/161 |
| 5,964,036 | A | | 10/1999 | Centofante | 30/161 |
| 5,966,816 | A | | 10/1999 | Roberson | 30/156 |
| D422,479 | S | | 4/2000 | Pardue | D8/99 |
| 6,079,106 | A | | 6/2000 | Vallotton | 30/161 |
| 6,122,829 | A | | 9/2000 | McHenry et al. | 30/161 |
| 6,125,543 | A | | 10/2000 | Jhones | 30/161 |
| 6,145,202 | A | | 11/2000 | Onion | 30/160 |
| D434,631 | S | | 12/2000 | Lum | D8/99 |
| 6,154,965 | A | | 12/2000 | Sakai | 30/161 |
| 6,158,127 | A | | 12/2000 | Taylor | 30/158 |
| D438,085 | S | | 2/2001 | Onion | D8/99 |
| 6,256,888 | B1 | | 7/2001 | Shuen | 30/161 |
| 6,276,063 | B1 | | 8/2001 | Chen | 30/161 |
| 6,289,592 | B1 | | 9/2001 | Emerson | 30/161 |
| 6,308,420 | B1 | | 10/2001 | Moser | 30/161 |
| 6,338,431 | B1 | | 1/2002 | Onion | 230/161 |
| 6,378,214 | B1 | | 4/2002 | Onion | 30/161 |
| 6,397,476 | B1 | | 6/2002 | Onion | 30/160 |
| 6,397,477 | B1 | | 6/2002 | Collins | 30/161 |
| 6,427,334 | B2 | | 8/2002 | Onion | 30/161 |
| 6,427,335 | B1 | | 8/2002 | Ralph | 30/161 |
| 6,430,816 | B2 | | 8/2002 | Neveux | 30/161 |
| 6,434,831 | B2 | | 8/2002 | Chen | 30/161 |
| 6,438,848 | B1 | | 8/2002 | McHenry et al. | 30/161 |
| D462,581 | S | | 9/2002 | Parlowski | D7/649 |
| D462,582 | S | | 9/2002 | Parlowski | D7/649 |

| | | | | |
|---|---|---|---|---|
| 6,442,843 | B1 | 9/2002 | Jue et al. | 30/151 |
| 6,490,797 | B1 | 12/2002 | Lake et al. | 30/161 |
| 6,553,671 | B2 | 4/2003 | Blanchard | 30/161 |
| 6,574,869 | B1 | 6/2003 | McHenry et al. | 30/161 |
| 6,591,504 | B2 | 7/2003 | Onion | 30/160 |
| 6,651,344 | B2 | 11/2003 | Cheng | 30/159 |
| 6,675,484 | B2 * | 1/2004 | McHenry et al. | 30/161 |
| 6,732,436 | B2 * | 5/2004 | Moizis | 30/155 |
| D498,985 | S | 11/2004 | Kerr et al. | D7/649 |
| 6,810,588 | B1 * | 11/2004 | Cheng | 30/153 |
| 7,000,323 | B1 * | 2/2006 | Hatcher et al. | 30/155 |
| 7,296,355 | B2 * | 11/2007 | Onion | 30/159 |
| D560,995 | S * | 2/2008 | Onion | D8/99 |
| D560,996 | S * | 2/2008 | Onion | D8/99 |
| D570,180 | S * | 6/2008 | Onion et al. | D8/99 |
| 7,421,751 | B2 * | 9/2008 | Ruggiero | 30/155 |
| 7,458,159 | B2 * | 12/2008 | Galyean et al. | 30/160 |
| 2002/0000042 | A1 | 1/2002 | Glesser et al. | 30/160 |
| 2002/0157260 | A1 | 10/2002 | Cheng | 30/161 |
| 2003/0070299 | A1 | 4/2003 | Frazer | 30/161 |
| 2003/0089750 | A1 | 5/2003 | Martinez | 224/232 |
| 2003/0226260 | A1 | 12/2003 | Sullivan | 30/160 |
| 2004/0020058 | A1 | 2/2004 | Vallotton | 30/160 |
| 2005/0097754 | A1 | 5/2005 | Onion | 30/159 |
| 2006/0248728 | A1 * | 11/2006 | Gibbs | 30/161 |
| 2007/0068002 | A1 * | 3/2007 | Onion | 30/161 |
| 2009/0119926 | A1 * | 5/2009 | Nenadic | 30/161 |
| 2009/0183375 | A1 * | 7/2009 | Kao | 30/159 |
| 2009/0217533 | A1 * | 9/2009 | Kao | 30/159 |
| 2009/0271989 | A1 * | 11/2009 | VanHoy | 30/159 |
| 2009/0293286 | A1 * | 12/2009 | Williams | 30/158 |
| 2010/0218383 | A1 * | 9/2010 | Williams | 30/158 |
| 2010/0242288 | A1 * | 9/2010 | Onion | 30/160 |
| 2010/0275447 | A1 * | 11/2010 | Perreault | 30/161 |
| 2010/0299934 | A1 * | 12/2010 | VanHoy | 30/161 |
| 2011/0067246 | A1 * | 3/2011 | Perez | 30/158 |

FOREIGN PATENT DOCUMENTS

| | | |
|---|---|---|
| DE | 1 104 386 | 4/1961 |
| DE | 2146066 | 4/1973 |
| EP | 0 230 000 | 7/1987 |
| FR | 493 741 | 8/1919 |
| FR | 1 069 862 | 7/1954 |
| FR | 1 171 740 | 1/1959 |
| FR | 1 248 117 | 10/1960 |
| FR | 2610237 | 8/1988 |
| FR | 2 705 606 | 12/1994 |
| JP | 3-227601 | 10/1991 |
| JP | 4-030979 | 2/1992 |

* cited by examiner

CLOSABLE KNIFE WITH OPENING MECHANISM

CROSS-REFERENCE TO RELATED APPLICATION

This application claims the benefit of U.S. Provisional Patent Application No. 60/687,503 filed Jun. 3, 2005, where this provisional application is incorporated herein by reference in its entirety.

BACKGROUND OF THE INVENTION

1. Field of the Invention

Disclosed embodiments of the invention generally relate to folding knives, and more particularly, to knives employing assisted-opening mechanisms.

2. Description of the Related Art

A folding knife typicality includes a blade and handle pivotably coupled to allow the blade to rotate, relative to the handle, between an open position, in which the blade extends from the handle, and a closed position, in which the blade is received in a corresponding recess in the handle. Such knives have enjoyed wide use for more than a hundred years due to their compactness, ease of handling, safety, and versatility.

The recent development of various assisted-opening mechanisms for folding knives has been extremely popular, perhaps in part because of the added utility such mechanisms provide, while maintaining a level of safety that is not found in knives such as automatic, or "switch-blade" knives.

An assisted-opening mechanism typically includes a bias member or mechanism configured to move the blade toward the open position after the blade is manually rotated from the closed position to beyond a selected threshold. However, while the blade is in the closed position, the bias member is generally configured to apply a reverse bias to the blade, tending to hold the blade in the closed position.

Examples of knives equipped with assisted-opening mechanisms may be found in U.S. Pat. No. 6,145,202; U.S. Pat. No. 6,338,431; U.S. patent application Ser. No. 10/774,310; and U.S. patent application Ser. No. 10/680,751, all of which are incorporated herein by reference, in their entirety.

BRIEF SUMMARY OF THE INVENTION

According to an embodiment of the invention, a knife is provided, including a handle and a blade coupled to the handle so as to be movable between an open position in which the blade extends from the handle, and a closed position, in which the blade is received within the handle. A detent mechanism is configured to resist movement of the blade from the closed position toward the open position while less than a threshold bias is applied to the blade toward the open position, but to release the blade to move toward the open position when at least the threshold bias is applied to the blade toward the open position. The threshold bias is of such a degree that, when the blade is released by the detent mechanism, sufficient energy is imparted by the bias to the blade to carry the blade from the closed position to the open position.

BRIEF DESCRIPTION OF THE SEVERAL VIEWS OF THE DRAWING(S)

Figure 2:
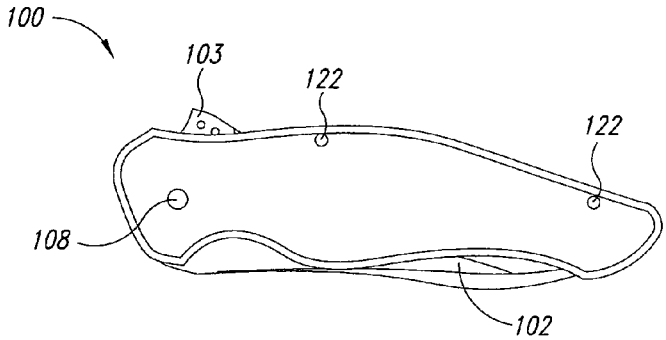

FIGS. 1 and 2 are side elevation views of a folding knife according to an embodiment of the invention.

Figure 3:
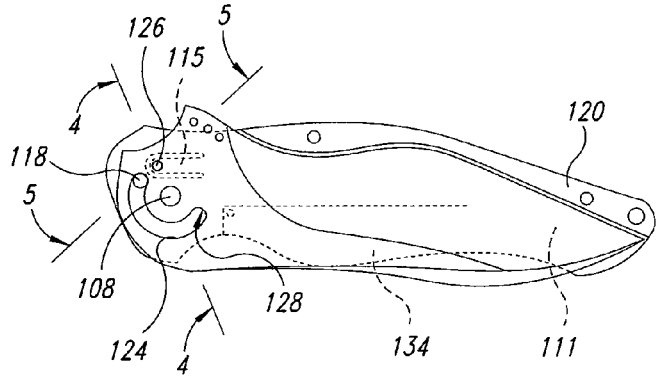
Figure 6:
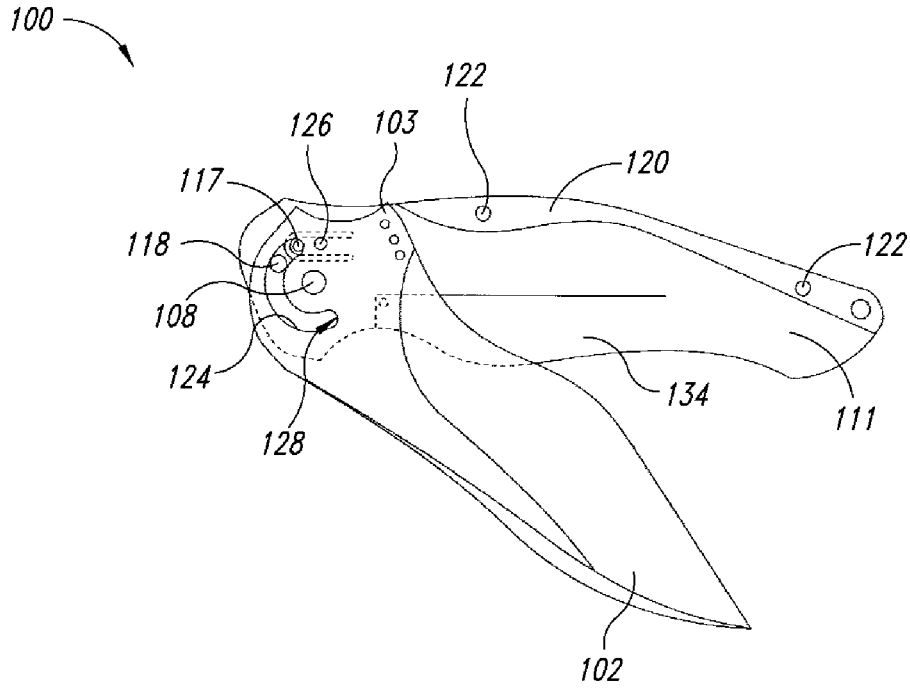
Figure 7:
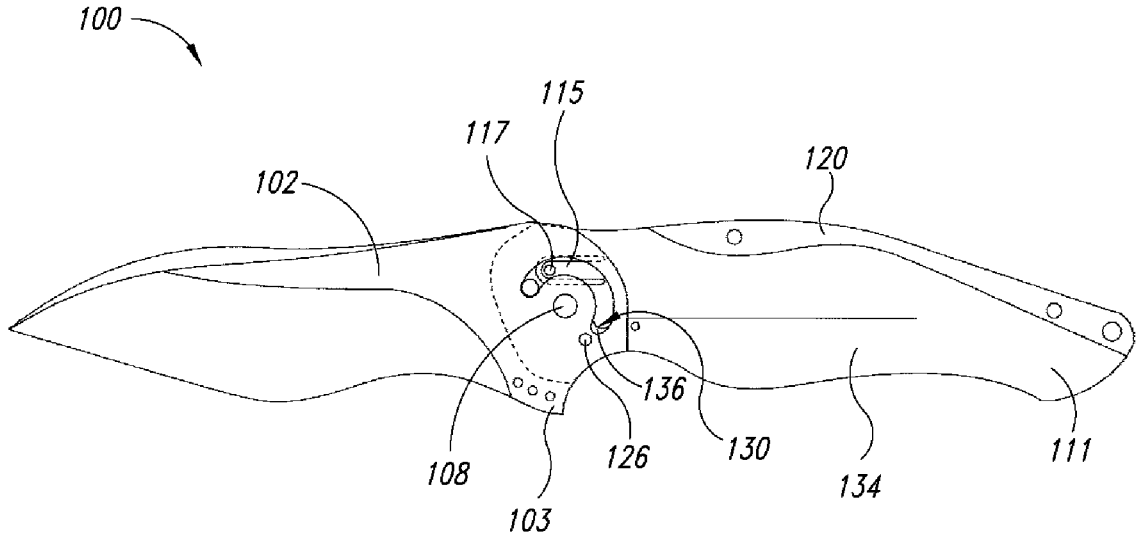

FIGS. 3, 6, and 7 show the knife of FIG. 1 in various positions, with a scale and liner removed.

Figure 4:
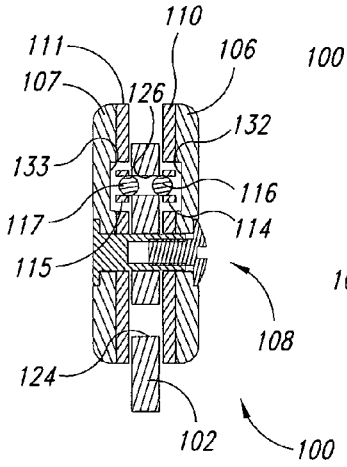
Figure 5:
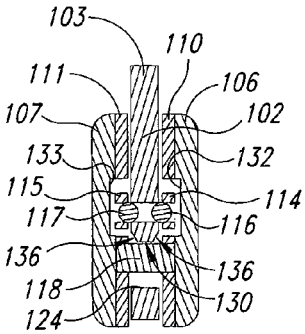

FIGS. 4 and 5 are enlarged cross-sectional views of the knife of FIG. 2, taken along planes indicated in FIG. 3 by lines 4-4 and 5-5, respectively.

Figure 8:
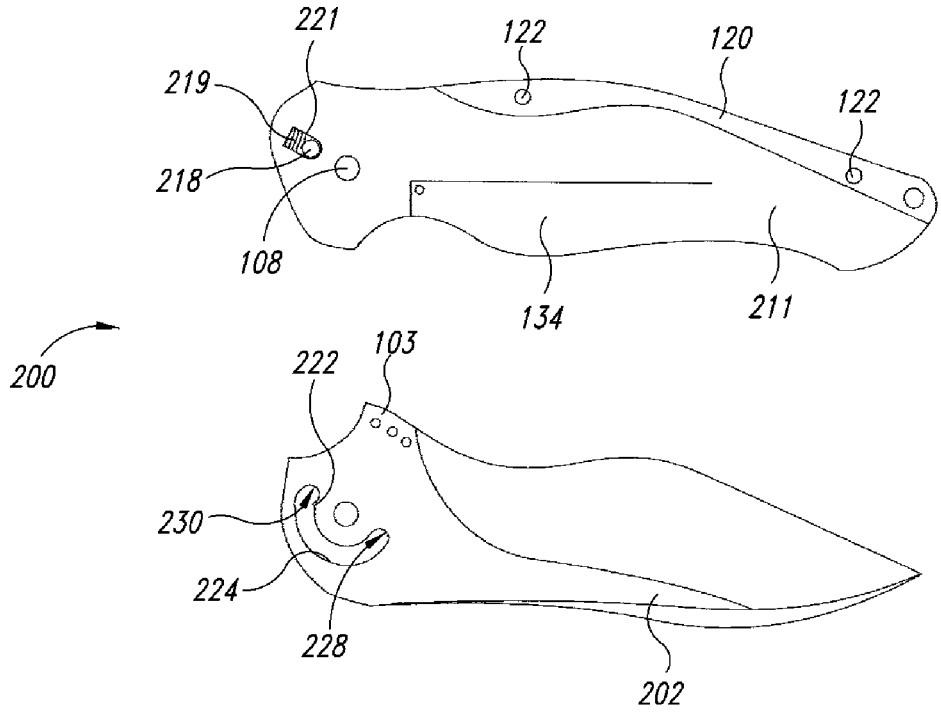
Figure 9:
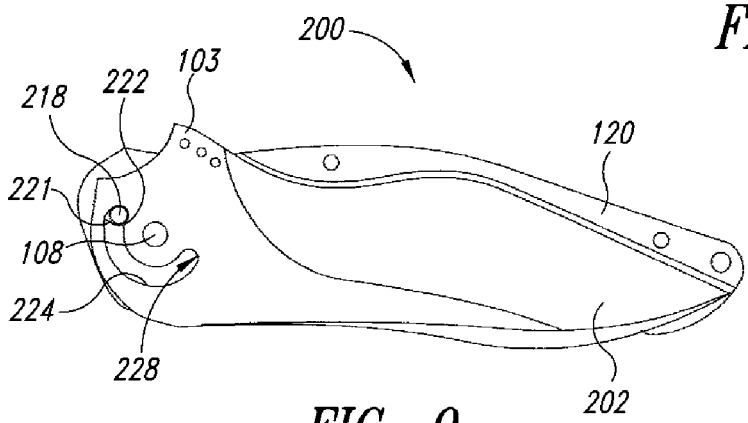
Figure 10:
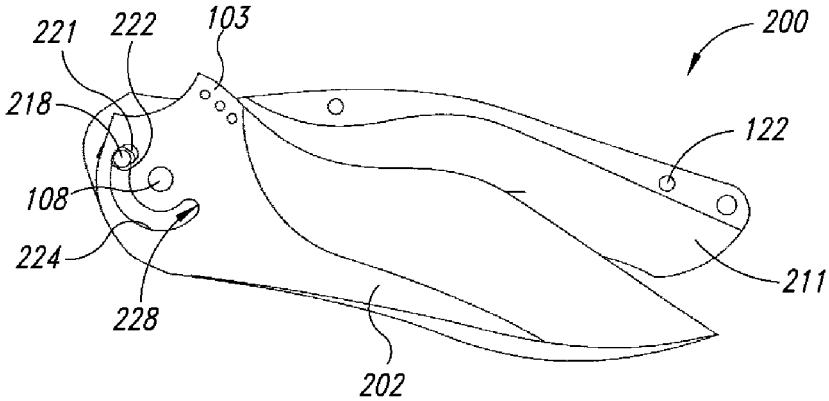

FIGS. 8-10 show features of a folding knife according to another embodiment of the invention.

DETAILED DESCRIPTION OF THE INVENTION

For the purpose of the present disclosure, the use of terms such as above, below, right, left, etc., may be used to describe features of the embodiments, and are to be understood as referring to the features as they appear in the figures, without limiting those features as they may be employed in actual embodiments. Where used, the terms inward, and outward will be with reference to a center of the described device.

Many commonly known features of folding knives are omitted in the figures and descriptions of embodiments of the invention. For example, fasteners, such as machine screws, bolts, rivets, pins, etc., are well known in the art, and need not be discussed in detail here. Where they are shown at all in the figures, fasteners are indicated generically by reference number 122 and are not detailed in the description. It is understood that one of ordinary skill will be able to provide appropriate fasteners in accordance with any specific configuration or design. Likewise, the element around which the blade pivots is referred to herein as the pivot point, and is shown in the figures merely as an aperture in the handle or blade. One of ordinary skill will recognize that a pin, rivet, machine screw, or similar element or group of elements is employed in these apertures. Other features may be described to provide context for the embodiments disclosed, but are not essential to the invention or particular embodiments thereof. Accordingly, no feature or element is to be construed as being essential to a claimed embodiment unless specifically indicated as such.

FIGS. 1 and 2 are side elevation views of a folding knife 100 according to an embodiment of the invention. The knife 100 includes a blade 102 and a handle 104 pivotally coupled together at pivot point 108 such that the blade 102 can be rotated, relative to the handle 104, around the pivot point 108 between an open position, as shown in FIG. 1, in which the blade 102 extends from the handle 104, and a closed position, in which the blade is received in a space provided in the handle, as shown in FIG. 2. The handle 104 includes a first scale 106 and a second scale 107. The handle also includes first and second liners 110, 111, and a backspacer 120, as described hereafter. The blade 102 includes an extended tang portion 103 that, when the blade 102 is in the closed position, extends out a back side of the handle 104 as shown in FIG. 2. This extended portion 103 is sometimes referred to by other terms, including flipper or kicker, and will be referred to hereafter as the flipper.

FIGS. 3, 6, and 7 show the knife 100 with the first scale 106 and the first liner 110 removed to reveal the underlying structure of the knife 100. As shown in FIGS. 3, 6, and 7, the knife 100 includes the blade 102, the backspacer 120, and the second liner 111, shown partially in hidden lines where obscured by the blade 102. The backspacer 120 is fixed between the first and second liners 106, 107 to provide the space to receive the blade 102 while the blade 102 is in the closed position. The second liner 111 includes a liner lock 134 of a type well known in the art.

With the exception of the liner lock 134, which is present only in the second liner 111, the first and second liners 110, 111 are substantially symmetrical, each having features that are mirrored by similar features of the other. Thus, an understanding of the overall structure of the knife 100 can be obtained through a description of the partial views shown in the figures.

FIGS. 4 and 5 are enlarged cross-sectional views of the knife 100 taken along planes that lie perpendicular to the viewing plane of FIGS. 1-3, 6, and 7, as indicated in FIG. 3 by lines 4-4 and 5-5, respectively. FIGS. 4 and 5 show various aspects of the knife 100 as described below with reference to FIGS. 3-7.

A stop pin 118 extends between apertures in the first and second liners 110, 111, and is configured to limit the travel of the blade 102 between the open position and the closed position. The blade 102 includes an arcuate slot 124 within which the stop pin 118 travels as the blade rotates between the open and closed positions. The open and closed positions are defined by first and second ends 128, 130, respectively, of the arcuate slot 124; that is, when the blade 102 is in the closed position, as shown in FIG. 3, the stop pin 118 is in full contact with the second end 130 of the arcuate slot 124, and when the blade 102 is in the open position, as shown in FIG. 7, the stop pin 118 is in full contact with the first end 128 of the arcuate slot 124. For clarity, the first end 128 of the arcuate slot is labeled in FIGS. 3 and 6, while the second end 130 is labeled in FIGS. 5 and 7.

"U" shaped slots formed in the first and second liners 110, 111 define respective first and second finger springs 114, 115. First and second detent bumps 116, 117 are formed on inner facing surfaces of the finger springs 110, 111, respectively, such that the detent bumps 116, 117 bear against the blade 102 along a common axis that lies perpendicular to a plane defined by the blade 102. In the present embodiment, the detent bumps 116, 117 comprise ball bearings press fitted into apertures formed in the finger springs 114, 115, as shown in FIG. 4. However, the bumps may be formed in any manner that provides features that function as described.

The blade 102 includes a detent aperture 126 positioned on the same arc as the arcuate slot 124, and slightly ahead thereof. The detent aperture 126 may comprise a single aperture that fully traverses the blade 102, as shown in FIG. 4, or may comprise depressions formed on opposite sides of the blade 102. When the blade 102 is in the closed position, as shown in FIG. 3, the detent bumps of the finger springs 114, 115 engage the detent aperture 126 on opposite sides of the blade 102 and serve to hold the blade in the closed position, as shown in FIGS. 4 and 5. Thus, in FIG. 3, the detent bump 117 and the detent aperture occupy the same position, so the detent bump is not separately visible. When the blade 102 is moved toward the open position, the finger springs 114, 115 of the first and second liners 110, 111 are each forced to flex outward as their respective detent bumps 116, 117 move outward from the aperture 126 to a respective surface of the blade 102.

Referring to FIGS. 4 and 5, sectional views are provided, which show the first and second detent bumps 116, 117 as they engage the detent aperture 126, the blade 102 lying in the closed position. First and second cavities 132, 133 are formed in interior surfaces of respective handle scales 106, 107 in positions that correspond to the positions of the springs 114, 115, in order to provide clearance for the springs, permitting them to deflect outward when the detent bumps lift from the detent aperture 126. Also visible in FIG. 5 are ramped or tapered surfaces 136 providing a transition between the second end 130 of the arcuate slot 124 and the side surfaces of the blade 102. These surfaces 136 permit the detent bumps 116, 117 to move easily from the slot 124 to the sides of the blade 102 as the blade is moved from the open position to the closed position. To avoid obscuring other elements, the surface 136 is not shown in FIGS. 3 and 6, but it may be seen adjacent to the end 130 of the slot 124 in FIG. 7.

To open the knife, a user presses downward on the flipper 103 to pivot the blade 102 away from the closed position. In order to move the blade 102 away from the closed position, the detent bumps 116, 117 must be forced to rise out of the detent aperture 126. The finger springs 114, 115 resist this movement of the bumps, obliging the user to apply an increased bias to the flipper 103. When sufficient bias is applied to the flipper 103 to overcome the resistance of the finger springs 114, 115, the detent bumps 116, 117 rise to the respective surfaces of the blade, and resistance to movement of the blade 102 suddenly and substantially diminishes, releasing the blade to move very quickly toward the open position in response to the increased pressure to the flipper 103.

As the blade moves toward the open position, the arcuate slot 124 turns around the pivot point 108. The orbit of the arcuate slot 124 corresponds to the position of the detent bumps 116, 117 such that, as the blade 102 rotates a few degrees toward the open position, the detent bumps 116, 117 drop into the arcuate slot 124, thereby eliminating even the minimal friction induced by the detent bumps on opposing surfaces of the blade 102. FIG. 6 shows the point in the rotation of the blade 102 where the detent bumps 116, 117 first encounter the end 130 of the arcuate slot 124 as it rotates toward the open position. The arcuate slot 124 and the detent bumps 116, 117 are positioned relative to each other such that, as a user presses the extended tang portion 103 toward the handle 104, the detent bumps engage the arcuate slot 124 before the extended tang portion 103 is fully received in the opening in the back portion of the handle. FIG. 6 shows extended tang portion 103 just before being fully received in the handle opening. The distance between the second end 130 of the arcuate slot 124 and the detent aperture 126 determines the degree of rotation between the closed position and the point where the detent bumps drop into the arcuate slot 124. The distance is selected to be very short to limit the amount of drag imparted by the detent bumps 116, 117 on the surfaces of the blade 102 once the blade begins to move toward the open position.

While a small amount of energy is stored in the springs 114, 115 as the blade is forced away from the closed position, and then released as the detent bumps 116, 117 drop into the arcuate slot 124, most of the energy required to move the blade 102 from the closed position to the open position is stored in the user's finger as pressure is applied to the flipper 103 to overcome the resistance of the springs 114, 115. This energy is transferred to the blade 102 in the space of travel between the closed position and the point at which the flipper 103 is driven by the user's finger into the handle 104, which occurs very quickly due to the sudden release of the blade. In the present embodiment, this distance corresponds to a blade rotation of around 35°, but in other embodiments it may be more or less than this. Generally, the distance traveled by the user's finger will be short enough to be perceived as almost instantaneous, following the sudden release of the blade.

A small portion of the transferred energy serves to overcome the friction induced by the detent bumps 115, 116 on the surfaces of the blade 102 as they cross from the detent aperture 126 to the arcuate slot 124, while a much larger portion accelerates the rotation of the blade toward the open position. The force required to overcome the resistance of the springs 114, 115 is selected to be sufficient to carry the blade 102 the remainder of the travel between the closed and the open positions. Thus, generally, pressing against the flipper 103 with sufficient pressure to move the blade away from the closed position will cause the blade to move all the way to the open position.

In the embodiment described with reference to FIGS. 1-7, the arcuate slot 124 serves both to define the limits of rotation of the blade between the open and closed positions, and to permit the blade to travel between the detent bumps 116, 117 without drag. Alternative to this arrangement, means for arresting the blade as it travels between the open and closed positions may be provided by other known methods other than a stop pin and arcuate slot, in which case arcuate grooves, rather than a slot, may be provided on opposing faces of the blade to receive the detent bumps 116, 117 to reduce or eliminate drag.

Turning now to FIGS. 8-10, a knife 200 is illustrated in accordance with another embodiment of the invention. The knife 200 shares many structural similarities with the knife 100 of FIGS. 1-7. Identical reference numbers indicate structures of such similarity as to require little or no additional description. Like FIGS. 3, 6, and 7, FIGS. 8-10 omit the scale and liner from one side of the knife 200 to show the internal structure of the knife. Characteristics of the omitted features will be understood in view of the description of the elements shown and described.

FIG. 8 shows a blade 202 of the knife 200 separately from a liner 211 for descriptive purposes. According to the embodiment of FIGS. 8-10, a stop pin 218 is held in an elongated aperture 221 formed in the liner 211, and extends from the aperture 221 shown to a similar aperture formed in the opposing liner. A longitudinal axis of the elongated aperture 221 extends radially from a center of the pivot pin. 108. The stop pin 218 is slideably held in the aperture 221 by a spring 219 positioned in the aperture 221 so as to bias the stop pin 218 toward the pivot pin 108. The blade 202 includes an arcuate slot 224 that serves a similar purpose to the slot 124 of the embodiment described with reference to FIGS. 1-7, to the extent that the stop pin 218 travels in the slot 224 as the blade rotates between the open and closed positions, and arrests rotation of the blade 202 when it makes contact with the first or second ends 228, 230 of the slot. However, the arcuate slot 224 further includes a detent bump or shoulder 222 near the second end 230 of the slot 224. When the blade 202 lies in the closed position, the stop pin 218 rests between the shoulder 222 and the end 230 of the slot 224. In order for the blade 202 to move away from the closed position toward the open position, the stop pin 218 must move radially outward, relative to the pivot point 108, to pass over the detent shoulder 222, sliding along the elongated aperture 221 against the bias of the spring 219. The shape of the shoulder 222 and the strength of the spring 219 are selected to resist movement of the stop pin 218 in the aperture 221 until sufficient pressure is applied to the flipper 103 of the blade 202 to move the blade 202 quickly to the open position without additional force being necessary. Once the pin 218 has passed the shoulder 222, the walls of the arcuate slot 224 are positioned, relative to the position of the stop pin 218, such that neither wall touches the stop pin until in has contacted the first end 228. In this way, once the resistance of the shoulder 222 and spring 219 have been overcome, resistance to rotation of the blade is nominal.

Liner locks, such as the lock 134 shown in the figures, are known to apply a drag on the side of the blade as the blade rotates. To minimize friction or resistance to rotation of the blade, other types of blade locks may be employed, though most known blade locks impose some resistance to the blade at some point in the travel. Accordingly, selection of an appropriate means for holding the blades in the open position is a design choice that will depend on factors such as, for example, size, shape, and weight of the blade; desired force threshold; detent mechanism employed; etc.

Assisted-opening type folding knives are known in the art. Typically, such a knife includes a bias member that is tensioned as the blade is moved from the open position toward a closed position, thereby storing energy that is later used to assist in moving the blade toward the open position again. In contrast, embodiments of the present invention provide an assisted-opening knife in which the energy required to move the blade from the closed to the open position is provided at the time the blade is opened, rather than stored previously. Furthermore, according to an embodiment, most or all of the energy necessary to move the blade from the closed to the open position is accumulated as energy potential in the user's own muscles, due to a selected resistance threshold which, when surpassed, suddenly drops to substantially no resistance, at which time the potential energy is released to the blade as kinetic energy that imparts sufficient inertia to the blade to carry it to the open position. According to another embodiment, the user applies a bias to a spring that in turn applies the bias to the blade, such that the energy to move the blade is stored in the spring rather than the user's finger, and when the resistance threshold is met, the spring releases the stored energy to the blade.

As used in the claims, the term coupled is not to be construed to require a direct physical connection between elements so claimed, but may also be read, for example, on structures having one or more intervening elements joined or connected between the coupled elements.

Bias, as used in the specification and claims, is an energy potential, such as a push, a pull, a difference in pressure, etc., that can impart energy to or through an element subject to the bias, in the form, for example, of kinetic energy.

The abstract of the present disclosure is provided as a brief outline of some of the principles of the invention, and is not intended as a complete or definitive description of any embodiment thereof, nor should it be relied upon to define terms used in the specification or claims. The abstract does not limit the scope of the claims.

Embodiments of the invention have been described with reference to folding knives. However, the scope of the invention is not limited to folding knives, but encompasses any closable knife, including knives in which a blade slides from a handle in a translation motion rather than a rotation motion.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention.

The invention claimed is:

1. A folding knife, comprising: a handle; a blade coupled to the handle such that the blade is rotatable around a pivot point between a fully open position and a closed position, in which the blade is received in a space in the handle, the blade including an arcuate slot and a detent aperture; a spring positioned to apply a bias along an axis that lies perpendicular to a plane defined by the blade; and a detent bump coupled to the spring and configured to engage the detent aperture while the blade is in the closed position and to rest in the arcuate slot during a portion of the rotation between the closed position and the fully open position, including the fully open position, thereby minimizing friction between the detent bump and the blade.

2. The folding knife of claim 1 wherein the blade further comprises an extended tang portion configured to extend from an opening in a back portion of the handle while the blade is in the closed position.

3. The folding knife of claim 2 wherein the arcuate slot and the detent bump are positioned such that, as a user presses the extended tang portion toward the handle, the detent bump engages the arcuate slot before the extended tang portion is fully received in the opening in the back portion of the handle.

4. The folding knife of claim 1 wherein the handle comprises a liner, and wherein the spring is a finger spring formed in the liner.

5. The folding knife of claim 1 wherein the handle comprises first and second liners, and wherein the spring is one of first and second finger springs formed in respective ones of the first and second liners, positioned to apply respective biases along the axis.

6. A knife, comprising: a handle; a blade coupled to the handle via a pivot, and configured to rotate around the pivot, relative to the handle, between a fully open position and a closed position, in which the blade is received within the handle; and a detent mechanism comprising a detent bump, the detent mechanism configured to prevent movement of the blade from the closed position toward the open position while less than a threshold force is applied to the blade toward the open position, and the blade having an arcuate slot lying on an arc centered on the pivot and having sufficient width and depth to accommodate the detent bump, thereby minimizing friction between the detent bump and the blade during a portion of the rotation from the closed position to the fully open position, the handle including a stop pin traversing the arcuate slot, the arcuate slot and stop pin being dimensioned and positioned to constrain travel of the blade between the open and closed positions.

7. The knife of claim 6 wherein the detent mechanism comprises a detent aperture formed in the blade and wherein the detent bump is coupled to the handle and positioned to rest in the aperture while the blade is in the closed position, and wherein the detent bump is also positioned such that, for a majority of the rotation between the closed and fully open positions, the detent bump rests in the arcuate slot such that the friction between the detent bump and the blade is minimized.

8. The knife of claim 6 wherein the stop pin remains position in arcuate slot during rotation of the blade from the closed position to the fully open position.

* * * * *